US010422061B2

(12) United States Patent
Sakuma

(10) Patent No.: US 10,422,061 B2
(45) Date of Patent: Sep. 24, 2019

(54) SEWING MACHINE NEEDLE CLAMPING DEVICE

(71) Applicant: SUZUKI MANUFACTURING LTD., Yamagata-Shi, Yamagata (JP)

(72) Inventor: Tohru Sakuma, Yamagata (JP)

(73) Assignee: SUZUKI MANUFACTURING LTD., Yamagata-Shi, Yamagata (JP)

( * ) Notice: Subject to any disclaimer, the term of this patent is extended or adjusted under 35 U.S.C. 154(b) by 0 days.

(21) Appl. No.: 15/312,039

(22) PCT Filed: Jun. 30, 2016

(86) PCT No.: PCT/JP2016/069417

§ 371 (c)(1),
(2) Date: Nov. 17, 2016

(87) PCT Pub. No.: WO2017/149793

PCT Pub. Date: Sep. 8, 2017

(65) Prior Publication Data

US 2018/0347088 A1 Dec. 6, 2018

(30) Foreign Application Priority Data

Feb. 29, 2016 (JP) ..... 2016-037066

(51) Int. Cl.
*D05B 55/02* (2006.01)
*D05B 55/10* (2006.01)

(52) U.S. Cl.
CPC ..... *D05B 55/02* (2013.01); *D05B 55/10* (2013.01); *D05D 2203/00* (2013.01)

(58) Field of Classification Search
CPC ..... D05C 9/02; D05C 9/04; D05B 55/02
See application file for complete search history.

(56) References Cited

U.S. PATENT DOCUMENTS 3,344,761 A * 10/1967 Ross ..... D05B 55/02 112/226
3,654,022 A * 4/1972 Wiest ..... G03C 1/93 156/220

(Continued)

FOREIGN PATENT DOCUMENTS

JP 2004_121280 A 4/2004
JP 2007_151777 A 6/2007
JP 3181298 U 1/2013

*Primary Examiner* — Tajash D Patel
(74) *Attorney, Agent, or Firm* — Bcon & Thomas, PLLC

(57) ABSTRACT

A sewing machine needle is attached firmly and easily, and is fixed and exchanged. A needle clamp 5 for clamping a sewing machine needle 3 has an accommodating recessed part 7 which accommodates a needle shank 15 of the sewing machine needle, a clamp lever which has a clamp arm 21 which engages to the needle shank, is freely opened and closed and is fixed to a clamp lever shaft 17 which is fitted loosely to an elongate hole which is bored at the needle clamp for the accommodating recessed part and a needle fixing spring 23 which repels elastically the clamp lever to an outer direction of a straight line which links a central point N of the needle shank and a central point of the clamp lever shaft, and the clamp arm has a force acting locking part 22 which slides on the needle shank of the sewing machine needle against elasticity of the needle fixing spring when rocking the clamp lever to a clamping direction "a" and passes a branch point position tp that the elasticity of the needle fixing spring of the straight line which links the central point of the needle shank of the sewing machine needle and the central point of the clamp lever shaft becomes maximum and holds a stable clamping state by the elasticity of the needle fixing spring.

4 Claims, 16 Drawing Sheets

(56) References Cited

U.S. PATENT DOCUMENTS

| | | | | |
|---|---|---|---|---|
| 4,493,279 | A * | 1/1985 | Odermann | D05B 85/00<br>112/220 |
| 7,428,876 | B2 * | 9/2008 | Hillenbrand | D05B 55/14<br>112/226 |
| 7,971,544 | B2 * | 7/2011 | Hillenbrand | D05C 11/04<br>112/226 |

* cited by examiner

Fig. 3 ( a )
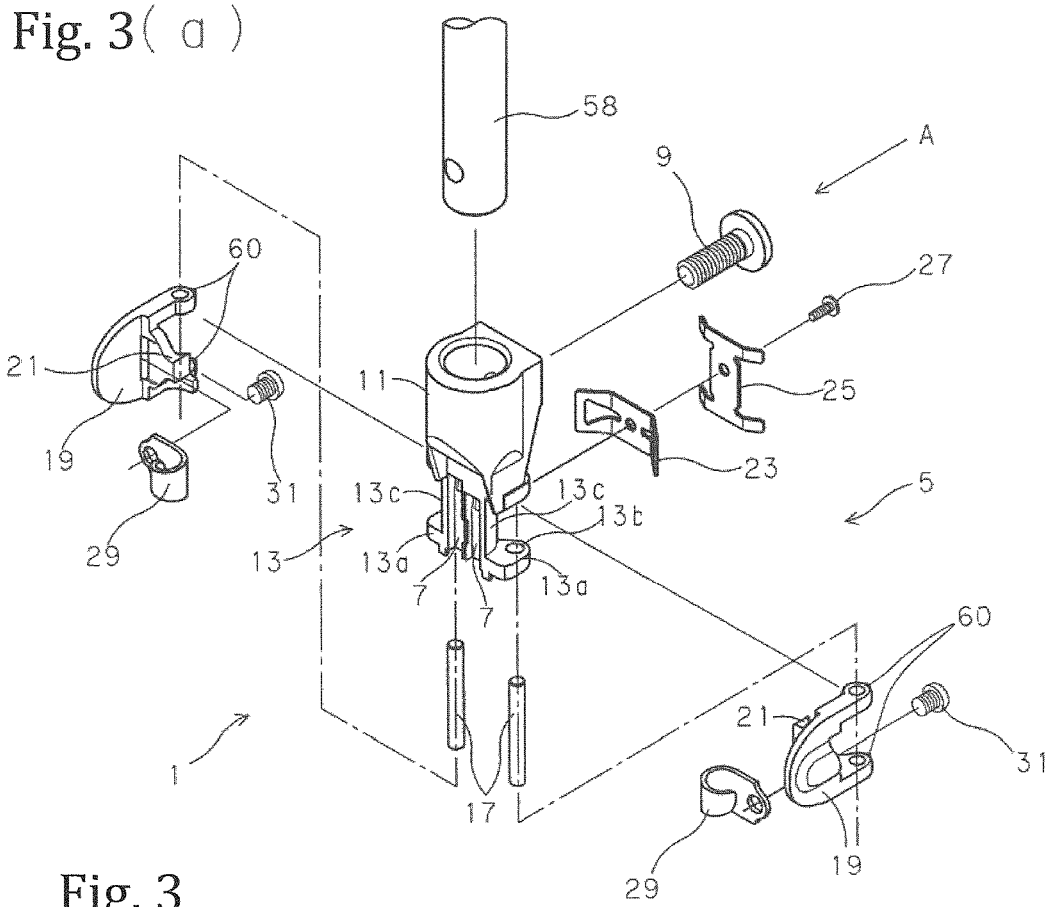
Fig. 3 ( b )
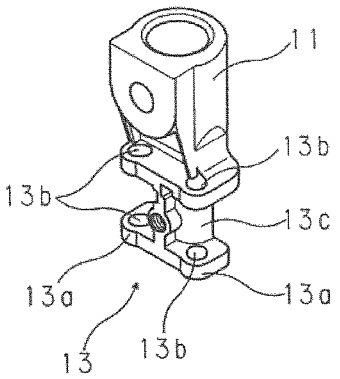

SEWING MACHINE NEEDLE CLAMPING DEVICE

FIELD OF THE ART

The present invention relates to a sewing machine needle clamping device, and particularly relates to the sewing machine needle clamping device for attaching, fixing or exchanging a sewing machine needle of such as a lock stitch sewing machine, a serger, a double chain stitch sewing machine, or a cover stitch sewing machine to a needle clamp firmly and easily.

BACKGROUND OF THE ART

Conventionally, in the lock stitch sewing machine, the serger, the double chain stitch sewing machine, or the cover stitch sewing machine, etc., it is well known that a cloth which should be sewed is sandwiched between a throat plate and a presser foot which is pressed by a presser bar and is fed stitch by stitch by a feed dog mechanism, and stitches are formed on the cloth by the sewing machine needle and a shuttle hook or a looper as a loop capturing device.

In the meantime, the shuttle hook or the looper as the loop capturing device and the feed dog mechanism are driven by each drive mechanism from a lower shaft which is a drive shaft. On the other hand, the sewing machine needle is screwed by a screw to the needle clamp which is attached to the needle bar which is driven with an upper shaft which is transferred from the lower shaft by a lower shaft pulley, a timing belt and an upper shaft pulley (cf: Patent document Nos. 1-4).

PRIOR ART DOCUMENT

Patent Document

[Patent document No. 1] JP H05-085380 U
[Patent document No. 2] JP 2004-121280 A
[Patent document No. 3] JP 2007-151777A
[Patent document No. 4] JP 3181298 U

SUMMARY OF THE INVENTION

Problem to be Solved by the Invention

However, in the above-mentioned sewing machine needle clamping device, on the one hand, while holding a sewing machine needle shank at an attaching position of vertical direction in an inside of the needle clamp, on the other hand, it is necessary to screw the sewing machine needle by the screw to the needle clamp by contacting and holding an attaching flat surface which is provided on a peripheral surface of the sewing machine needle shank to an attaching flat surface of the inside of the needle clamp. In this case, an operation which is necessary to screw one or multiple sewing machine needles by the screw to each needle clamp by contacting and holding to the attaching flat surface of the inside of the needle clamp firmly by a screwdriver is a complicated work for operators of the sewing machine.

The present invention was conducted to solve these disadvantages. The object of the present invention is to provide the sewing machine needle clamping device that the above-mentioned operation which has to screw the sewing machine needle by the screw to the needle clamp firmly by a screwdriver is unnecessary and the mechanism is simplified and the operation is performed by one-touch operation and the sewing machine needle is attached and fixed to the needle clamp firmly and easily.

Means for Solving the Problems

In order to achieve the above-mentioned objects, a sewing machine needle clamping device of the present invention is the sewing machine needle clamping device for attaching a sewing machine needle to an accommodating recessed part of a needle clamp with the needle clamp comprising the accommodating recessed part which accommodates a needle shank of the sewing machine needle, the sewing machine needle clamping device of the present invention comprises a clamp lever which can rock freely and has a clamp arm which engages to the needle shank of the sewing machine needle, is freely opened and closed for the accommodating recessed part and is fixed to a clamp lever shaft which is fitted loosely to an elongate hole which is bored at the needle clamp, and a needle fixing spring which repels elastically the clamp lever to an outer direction of a straight line which links a central point of the needle shank of the sewing machine needle and a central point of the clamp lever shaft, and the clamp arm has a force acting locking part, which slides on the needle shank of the sewing machine needle against elasticity of the needle fixing spring when rocking the clamp lever to a clamping direction in a state that the needle shank of the sewing machine needle is engaged to the accommodating recessed part and butted in the attaching position of a vertical direction, and which passes a branch point position that the elasticity of the needle fixing spring of the straight line which links the central point of the needle shank of the sewing machine needle and the central point of the clamp lever shaft becomes maximum, and which holds a stable clamping state by the elasticity of the needle fixing spring.

Besides, in the sewing machine needle clamping device of the present invention, the needle shank of the sewing machine needle, the clamp lever shaft of the needle clamp and the clamp arm of the clamp lever are composed as sizes that a straight line and a distance which link the central point of an engagement surface of the clamp arm and the central point of the clamp lever shaft are corresponding to a straight line and a distance which link the central point of the needle shank of the sewing machine needle and the central point of the clamp lever shaft in a clamping state.

In the sewing machine needle clamping device of the present invention, the clamp lever of the needle clamp is freely opened and closed for the accommodating recessed part and is fixed to the clamp lever shaft which is pivotally attached to the elongate hole which is bored at an attaching part which is provided up and down in an attaching base of the needle clamp, and when the clamp lever shaft is pivotally attached in the elongate hole, it can pivotally move, and is stopped so that it cannot move in a vertical direction, and an elongate direction of the elongate hole is same direction as a straight line which links the central point of the needle shank of the sewing machine needle which is accommodated in the accommodating recessed part of the needle clamp and the central point of the clamp lever shaft.

In the sewing machine needle clamping device of the present invention, a magnetic body which attracts magnetically the needle shank of the sewing machine needle is incorporated in the accommodating recessed part which accommodates the needle shank of the sewing machine needle.

Effect of the Invention

According to a needle exchanging device of the sewing machine of the present invention, the mechanism is simplified and the operation is performed by one-touch operation of small number of times, and the sewing machine needle of such as the lock stitch sewing machine, the serger, the double chain stitch sewing machine, or the cover stitch sewing machine can be attached, fixed or exchanged to the needle clamp firmly and easily.

BRIEF DESCRIPTION OF THE DRAWINGS

FIG. 2 (*b*) A plane view of the sewing machine needle clamping device which clamps the sewing machine needle to the needle clamp by the present invention.

FIG. 2 (*c*) A back view of the sewing machine needle clamping device which clamps the sewing machine needle to the needle clamp by the present invention.

FIG. 2 (*d*) A perspective view of the sewing machine needle clamping device which clamps the sewing machine needle to the needle clamp by the present invention.

FIG. 3 (*a*) is an exploded perspective view of the sewing machine needle clamping device by the present invention, and (*b*) is a partial perspective view of the sewing machine needle clamping device seeing from a direction of an arrow A of (*a*).

FIG. 4 (*b*) A plane schematic view of the sewing machine needle clamping device in a state immediately after clamping the sewing machine needle to the needle clamp by the present invention.

FIG. 4 (*c*) A plane schematic view of the sewing machine needle clamping device in a state after further continuing a clamping operation of the sewing machine needle to the needle clamp by the present invention.

FIG. 4 (*d*) A plane schematic view of the sewing machine needle clamping device in a state which completed a clamping operation of the sewing machine needle to the needle clamp by the present invention.

FIG. 5 (*b*) A motion schematic view of the sewing machine needle clamping device in a state after further continuing a clamping operation of the sewing machine needle to the needle clamp by the present invention.

FIG. 5 (*c*) A motion schematic view of the sewing machine needle clamping device in a state which completed a clamping operation of the sewing machine needle to the needle clamp by the present invention.

FIG. 6 (*b*) A schematic view of the sewing machine needle clamping device by third embodiment of the present invention.

MODE FOR CARRYING OUT THE INVENTION

Figure 1:
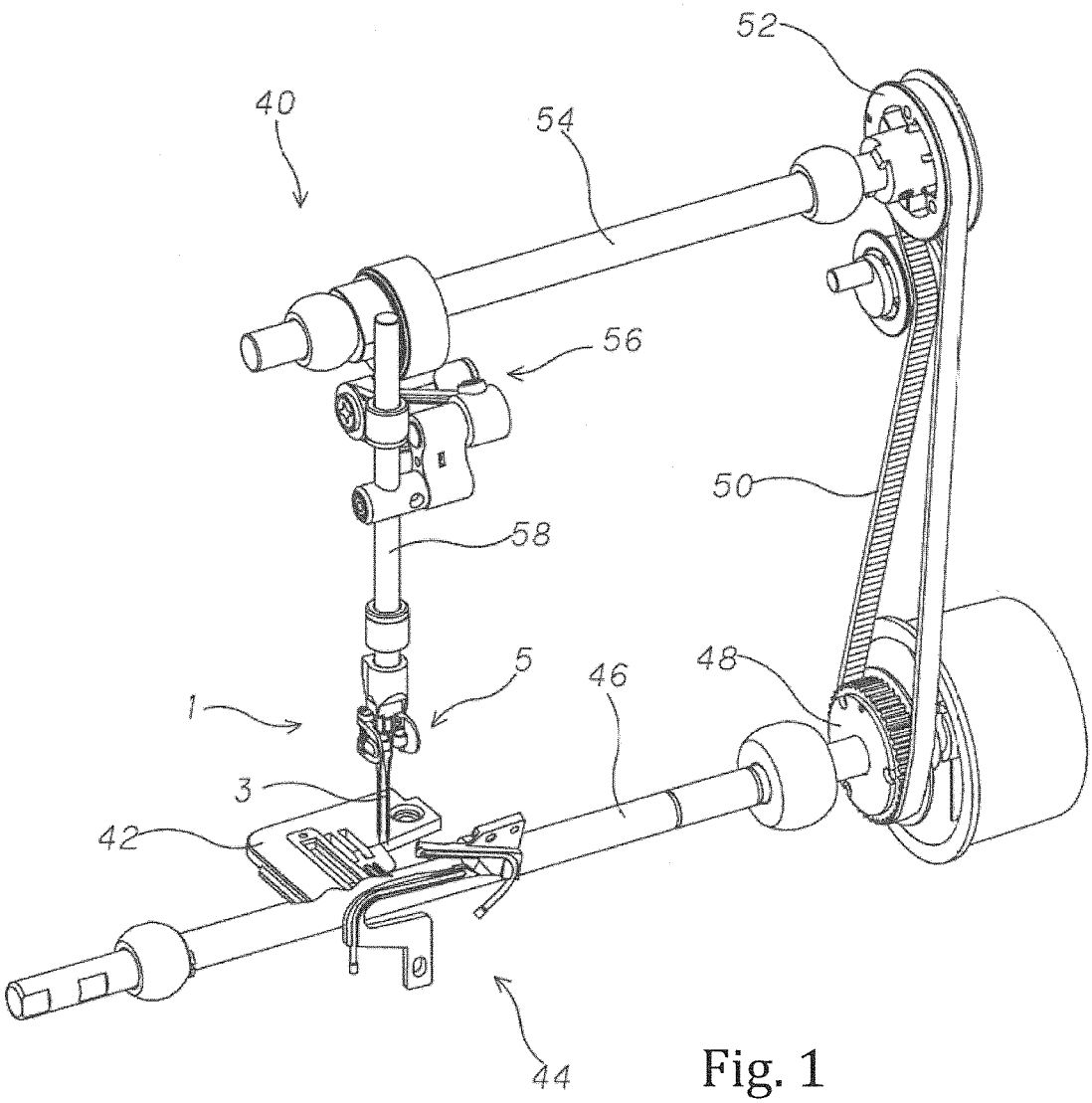
FIG. 1 A whole perspective view seeing from a front side of the sewing machine which attaches the sewing machine needle clamping device by the present invention.
Figure 2A:
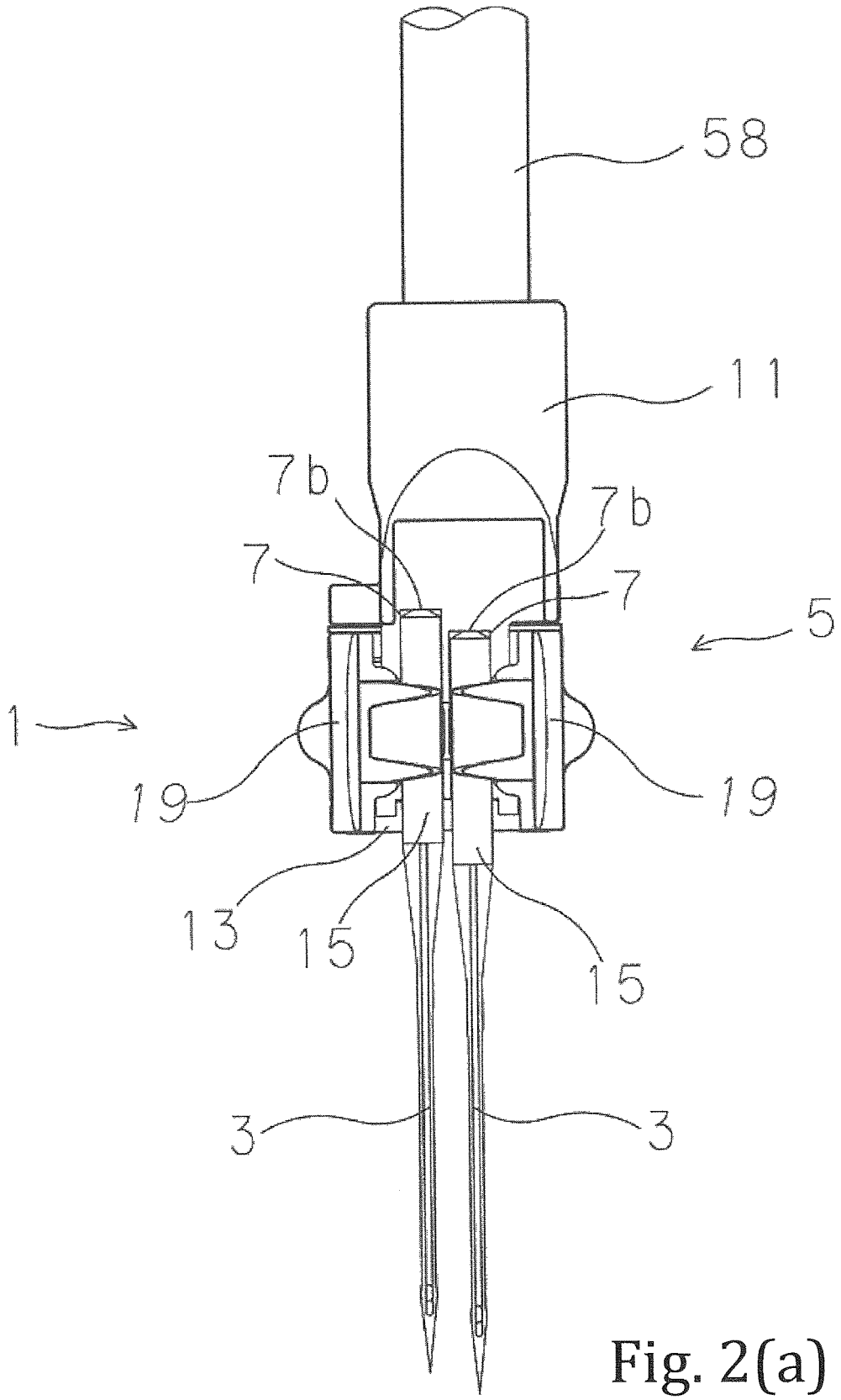
FIG. 2 (*a*) A front view of the sewing machine needle clamping device which clamps the sewing machine needle by first embodiment of the present invention.
Figure 2B:
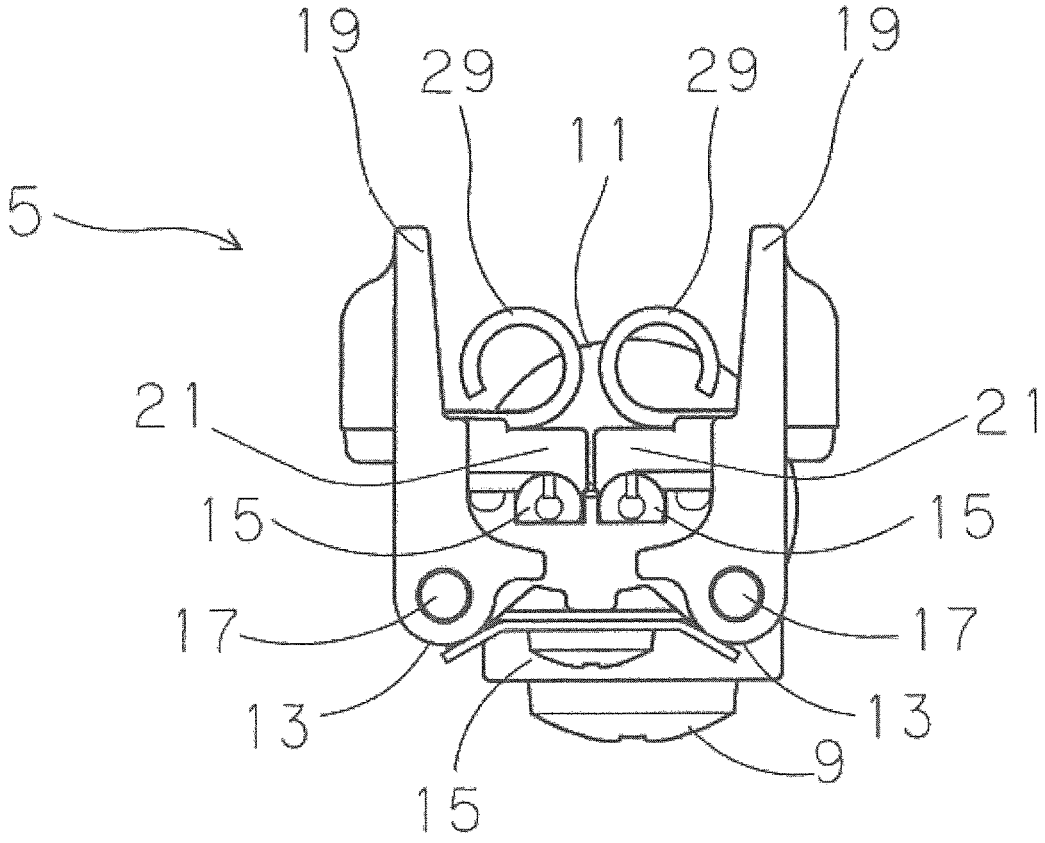
Figure 2C:
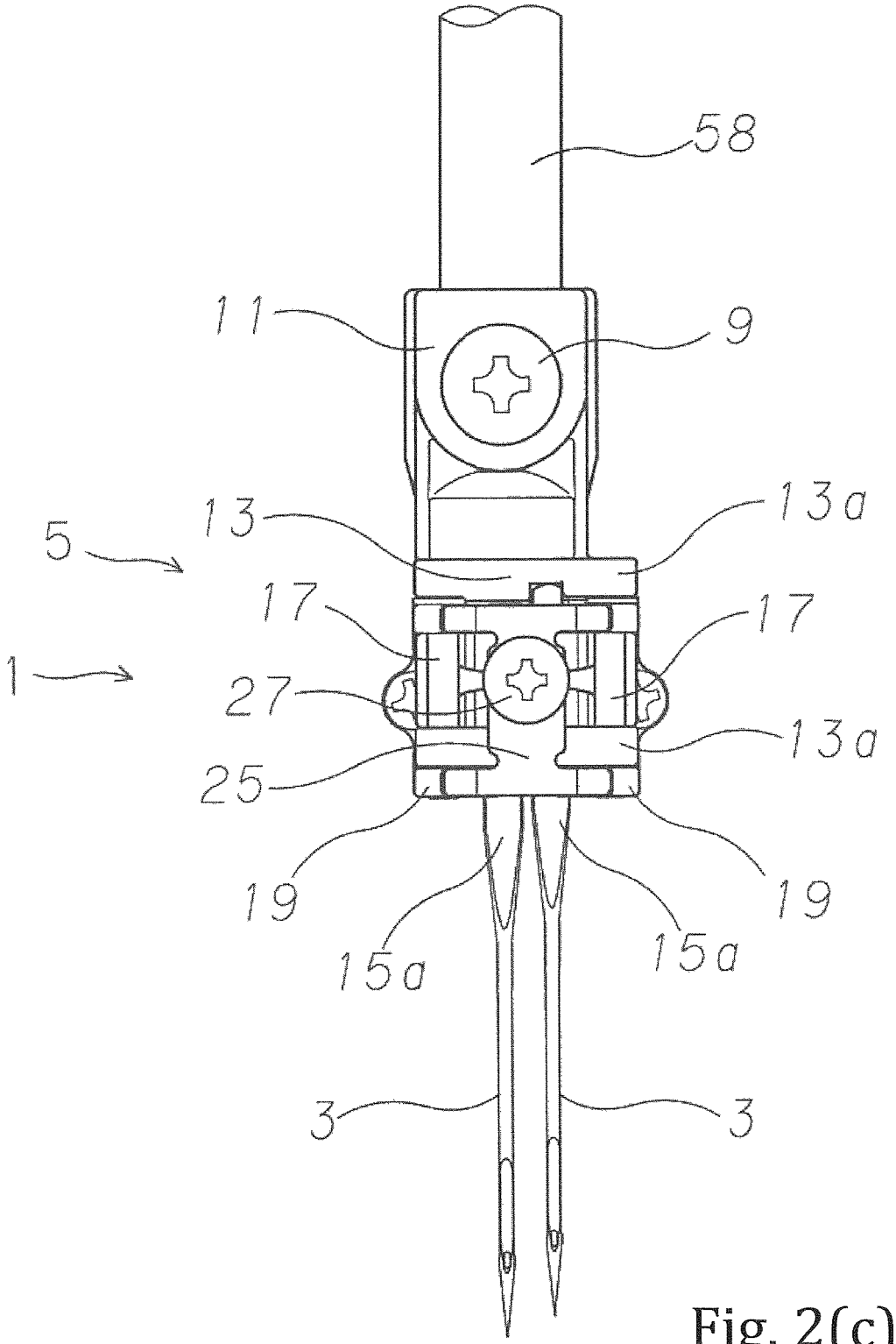
Figure 2D:
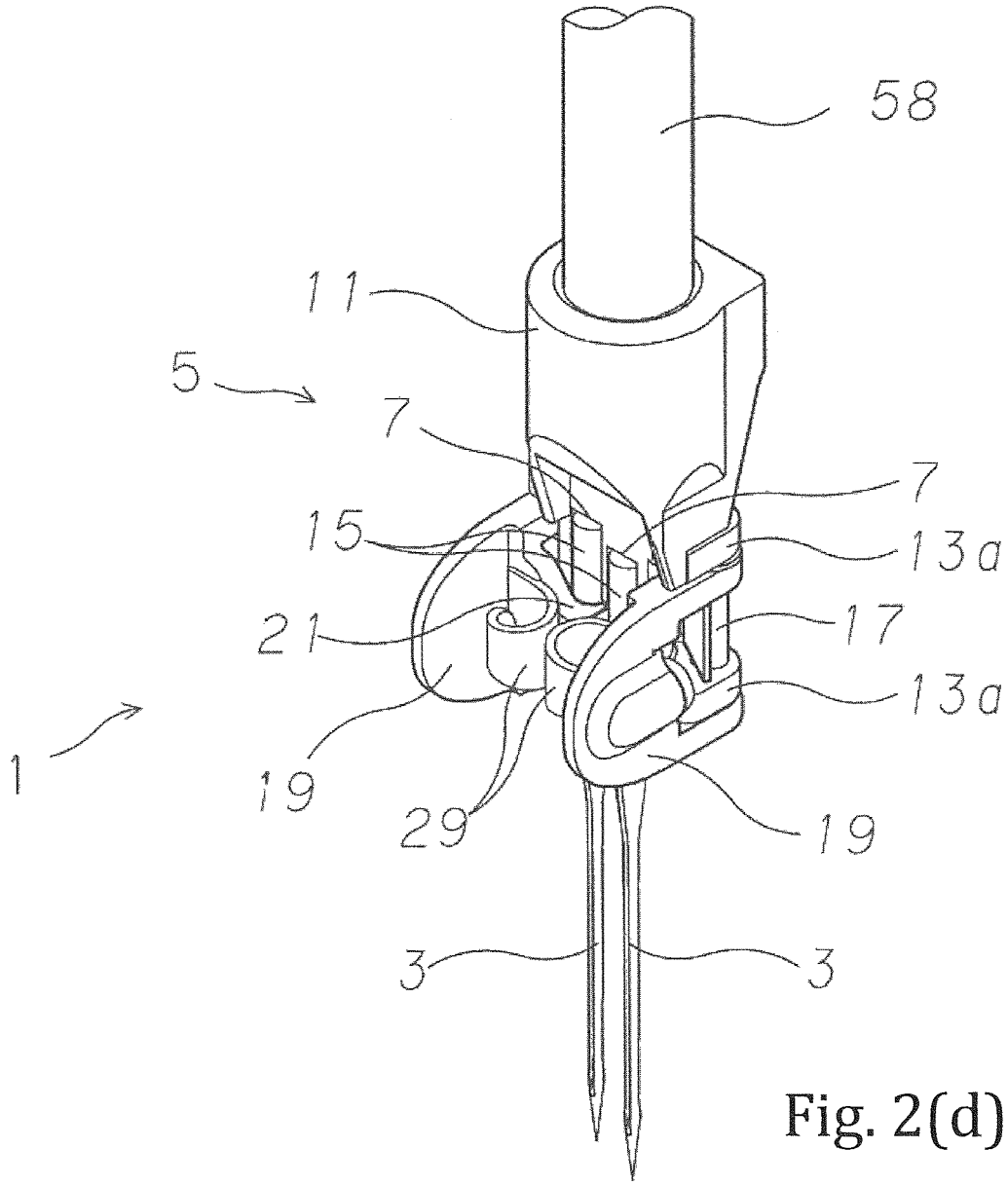
Figure 4A:
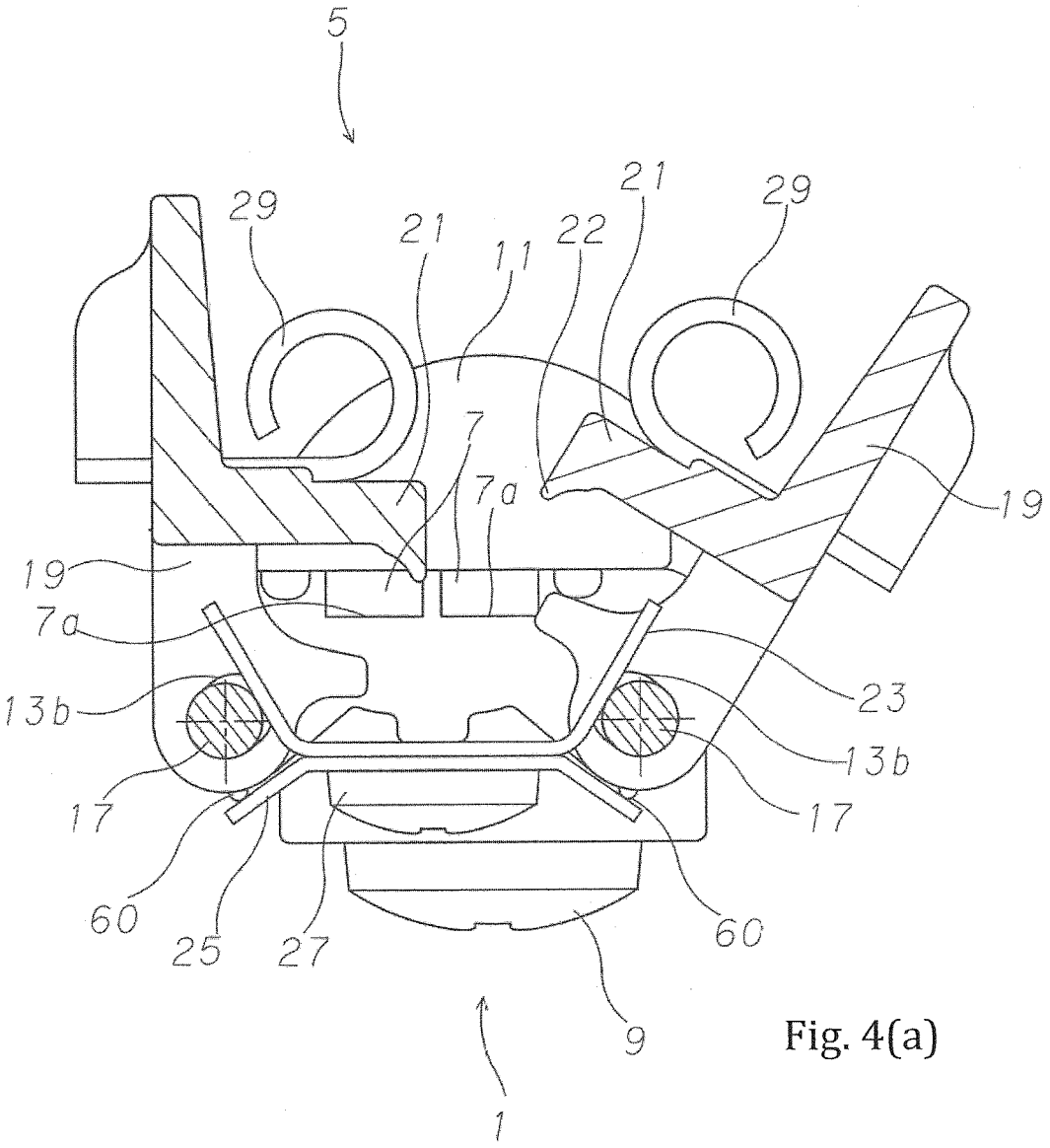
FIG. 4 (*a*) A plane schematic view of the sewing machine needle clamping device in a state before clamping the sewing machine needle to the needle clamp by the present invention.
Figure 4B:
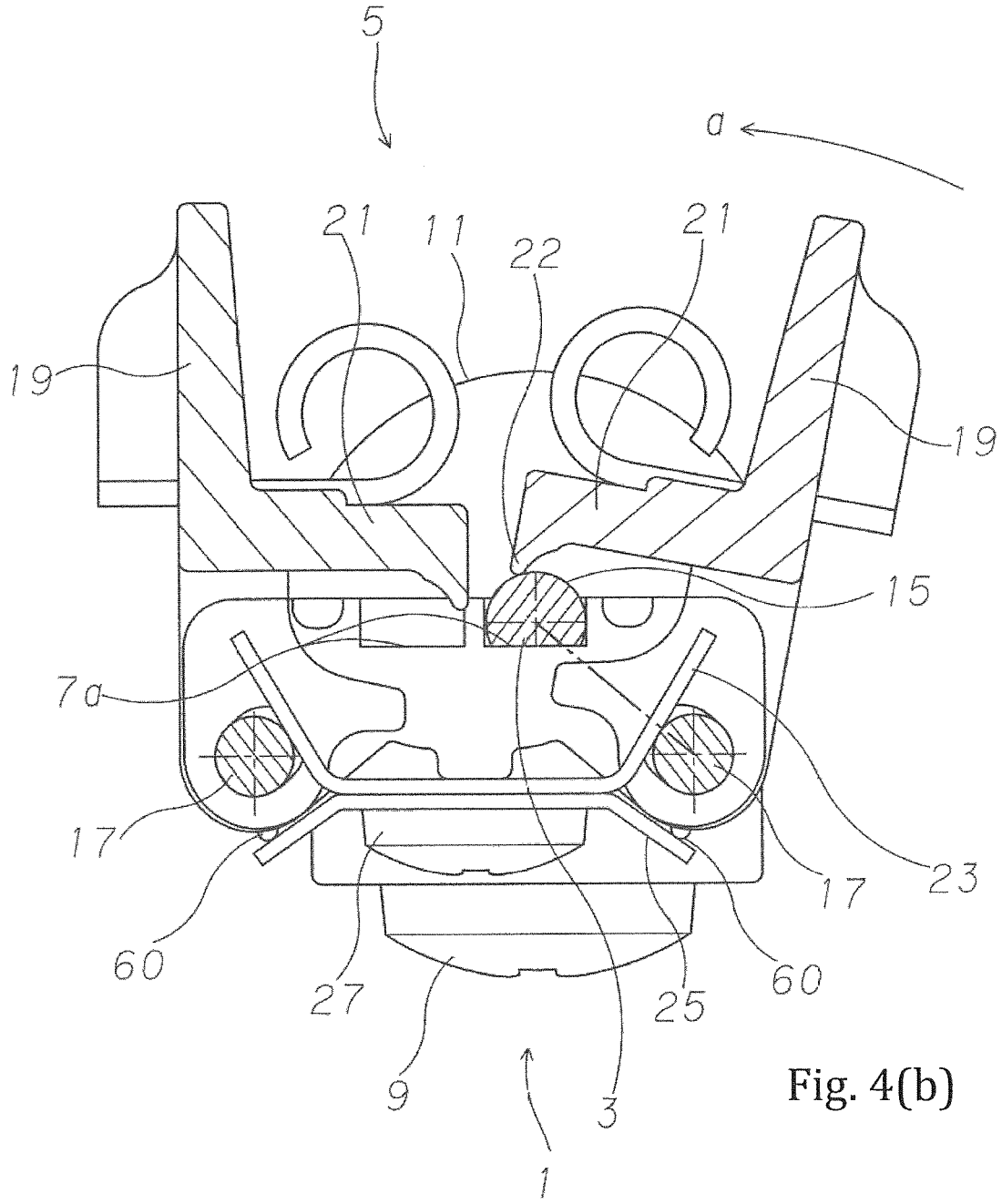
Figure 4C:
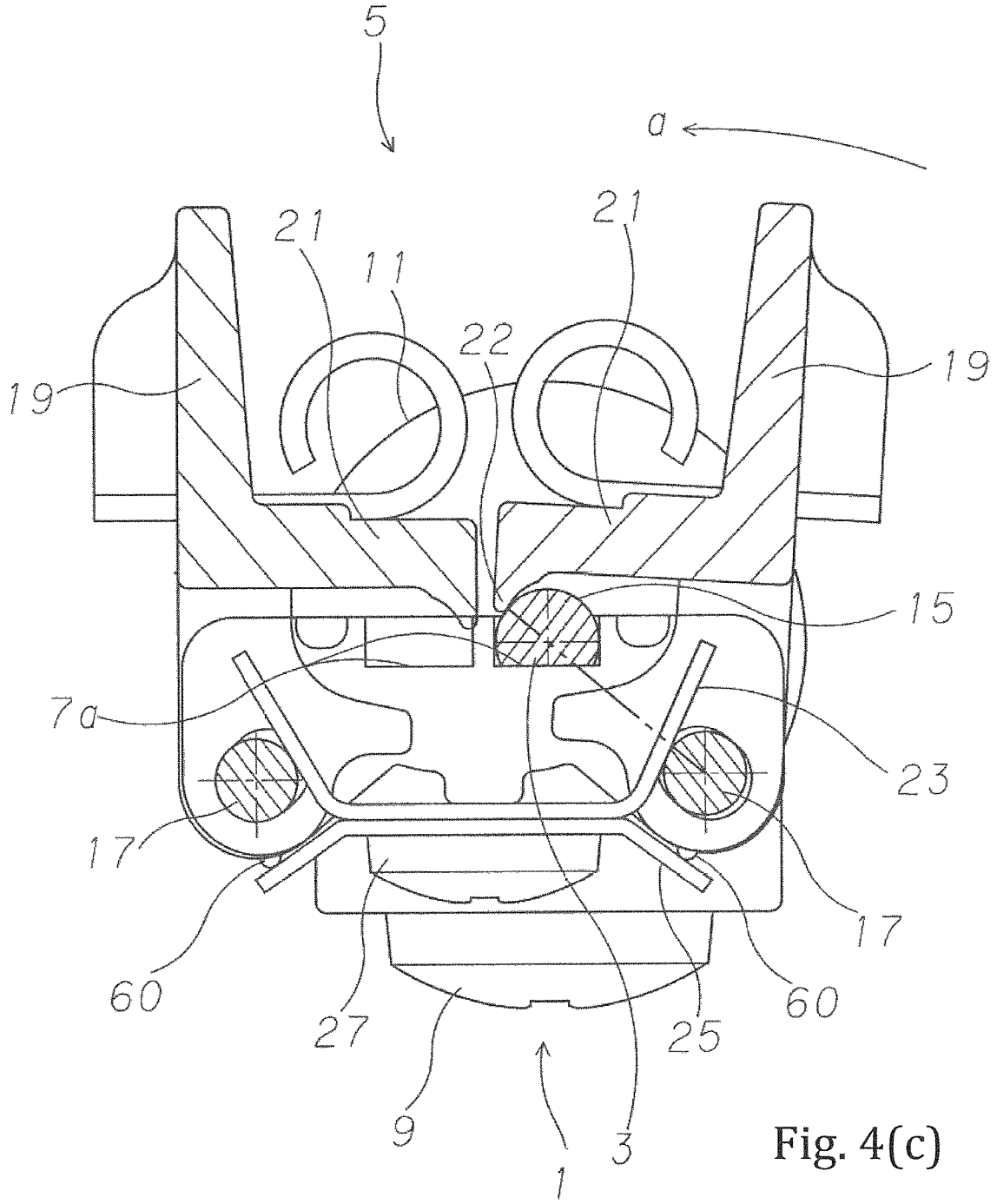
Figure 4D:
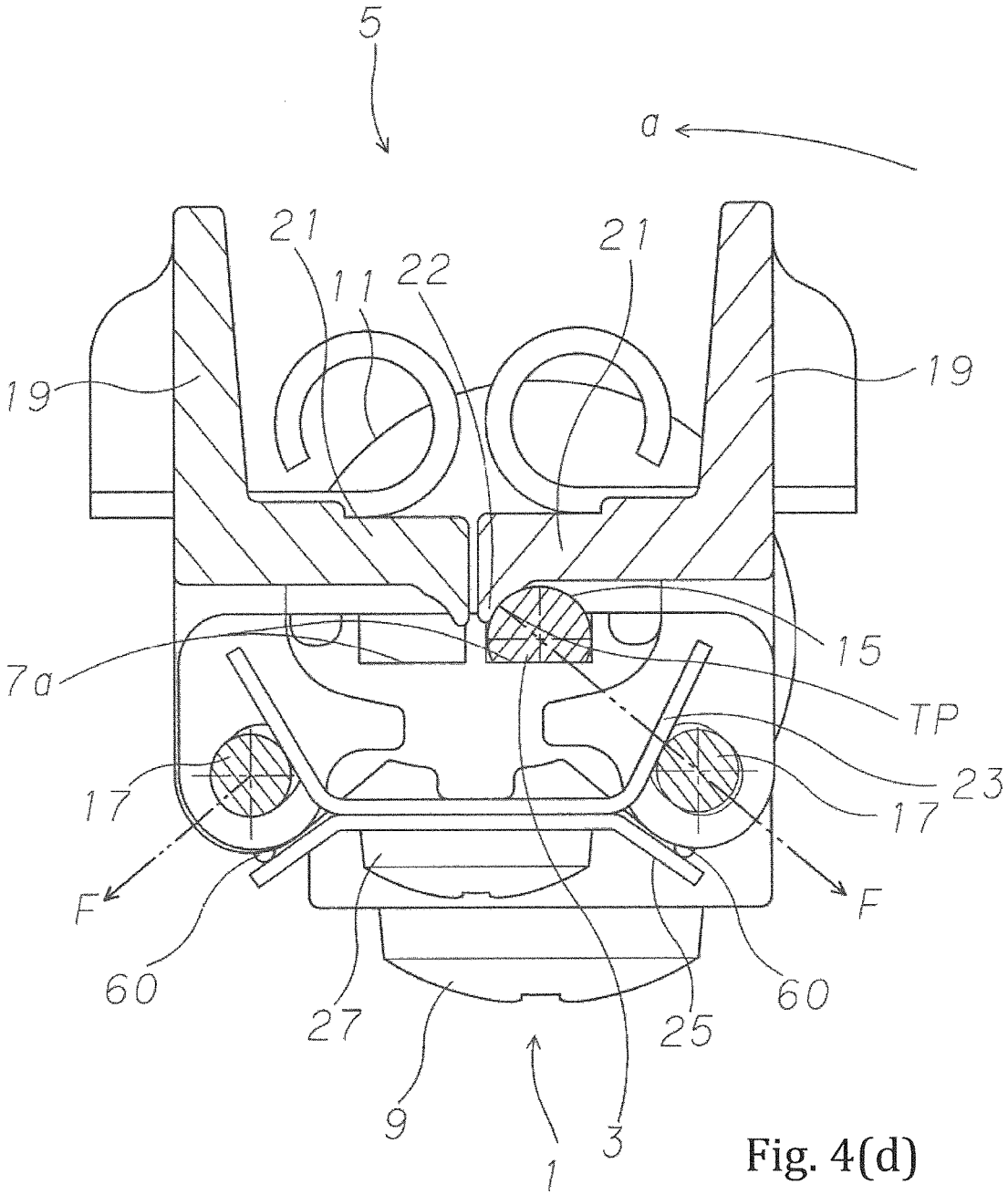

Hereinafter, the preferable embodiments that the sewing machine needle clamping device of the present invention is applied to a 2 (two) needles 4 (four) threads serger (hemstitch sewing machine) are explained in detail by referring to the drawings.

As shown in FIG. 1, in this 2 needles 4 threads hemstitch sewing machine (serger) 40, the cloth which should be sewed is sandwiched between the throat plate 42 and the presser foot which is pressed by the presser bar and is fed stitch by stitch by the feed dog mechanism, and stitches are formed on the cloth by the sewing machine needle 3 and the looper 44 as the loop capturing device.

This looper 44 as the loop capturing device and the feed dog mechanism are driven by each drive mechanism from the lower shaft 46 which is the drive shaft. On the other hand, the sewing machine needle 3 is fixed to the needle clamp 5 which is attached to the needle bar 58 which is driven by a needle bar drive mechanism 56 with the upper shaft 54 which is transmitted from the lower shaft 46 with rotation ratio of 1:1 by the lower shaft pulley 48, the timing belt 50 and the upper shaft pulley 52. The upper shaft 54 and the needle bar drive mechanism 56 are attached to a sewing machine arm. The throat plate 42, the looper 44 as the loop capturing device and the feed dog mechanism are attached to a sewing machine bed.

According to the above-mentioned 2 needles and 4 threads hemstitch sewing machine (serger) 40, the cloth which should be sewed is sandwiched between the throat plate 42 and the presser foot which is pressed by the presser bar and is fed stitch by stitch by the feed dog mechanism, and stitches are formed on the cloth by the sewing machine needle 3 and the looper 44 as the loop capturing device. However, because the number, the specific structure and the operation of the throat plate 42 and the looper 44 as the loop capturing device for forming the stitches are public known or well known, the detailed explanations are omitted.

As shown in FIG. 2-FIG. 6, a figure of the present invention exists in the sewing machine needle clamping device 1 which attaches the sewing machine needle 3 to the accommodating recessed part 7 of the needle clamp 5. Hereinafter, this is explained in detail as the first embodiment. The needle clamp 5 has a fixing cylindrical portion 11 that the needle clamp 5 is fitted into the needle bar 58 and attached by the screw 9 and an attaching base 13 which extends from it up and down integrally. In addition, as this embodiment, although the needle clamp 5 may be attached as a separate part from the needle bar 58, the needle clamp 5 may be formed to and attached to the needle bar 58 integrally. The needle clamp 5 has above-mentioned accommodating recessed part 7 which accommodates the needle shank 15 of the sewing machine needle 3 in a central attaching part 13*c* in the attaching base 13. The accommodating recessed part 7 and the attaching base 13 of the needle clamp 5 are arranged symmetrically one by one with respect to a central longitudinal section of the needle clamp 5.

In two sewing machine needles 3, an end face of the shank of the needle shank 15 is butted to different attaching position of vertical direction in the inside of the needle clamp 5 respectively and an attaching flat surface 15*a* which is provided at the peripheral surface of the needle shank 15 of the sewing machine needle 3 is abutted to an attaching flat surface 7*a* of the accommodating recessed part 7 in the inside of the needle clamp 5.

The needle clamp 5 has a clamp lever 19 which is freely opened and closed and is fixed to a clamp lever shaft 17 which is pivotally attached to an elongate hole 13*b* which is bored at an attaching part 13*a* which is provided up and down in the attaching base 13 of the needle clamp 5 for the accommodating recessed part 7. When the clamp lever shaft 17 is pivotally attached in the elongate hole 13*b*, it can pivotally move, and is stopped so that it cannot move in the vertical direction. An elongate direction of the elongate hole 13*b* is same direction as a straight line L2 which links a central point N of the needle shank 15 of the sewing machine needle 3 which is accommodated in the accommodating recessed part 7 of the needle clamp 5 and a central point P of the clamp lever shaft 17 (FIG. 5 (*a*)). The clamp lever 19 has a clamp arm 21 which engages to a peripheral surface of the needle shank 15 of the sewing machine needle 3.

Besides, the needle clamp 5 has a plate-like needle fixing spring 23 which repels elastically the clamp lever 19 to an outer direction of the straight line which links the central point N of the needle shank 15 of the sewing machine needle 3 and the central point P of the clamp lever shaft 17 and a plate-like spring 25 which fixes the clamp lever 19 by a protrusion 60 and prevents to move freely when the sewing machine needle 3 is not attached. Two plate-like springs are fixed to the attaching part 13*c* of the vertical direction of the attaching base 13 by a screw 27 in a central part by overlapping back to back. In addition, a thread guide 29 which guides a thread to a needle eye of the sewing machine needle is fixed to the clamp lever 19 by a screw 31.

Figure 5A:
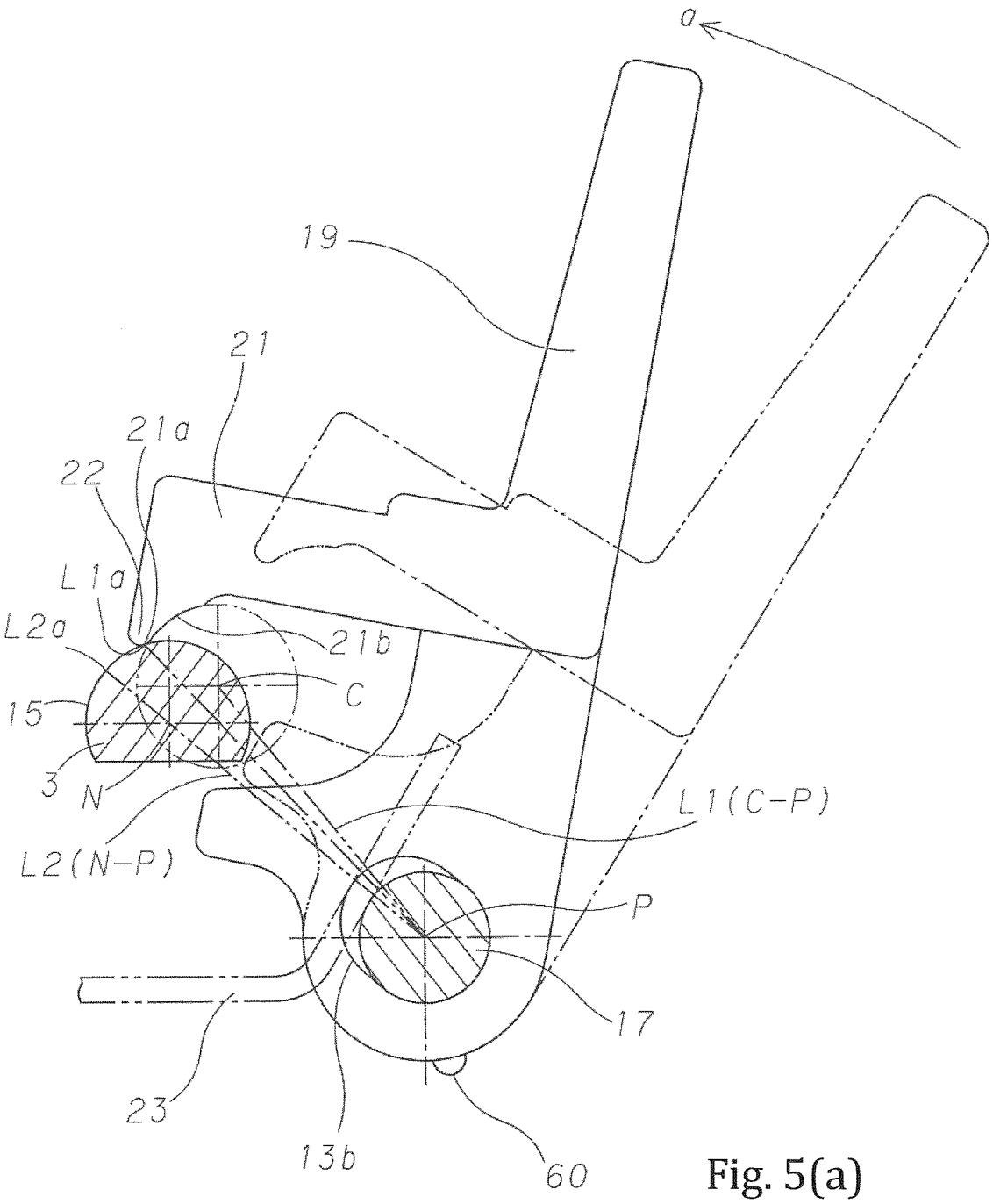
FIG. 5 (*a*) A motion schematic view of the sewing machine needle clamping device in a state immediately after clamping the sewing machine needle to the needle clamp by the present invention.
Figure 5B:
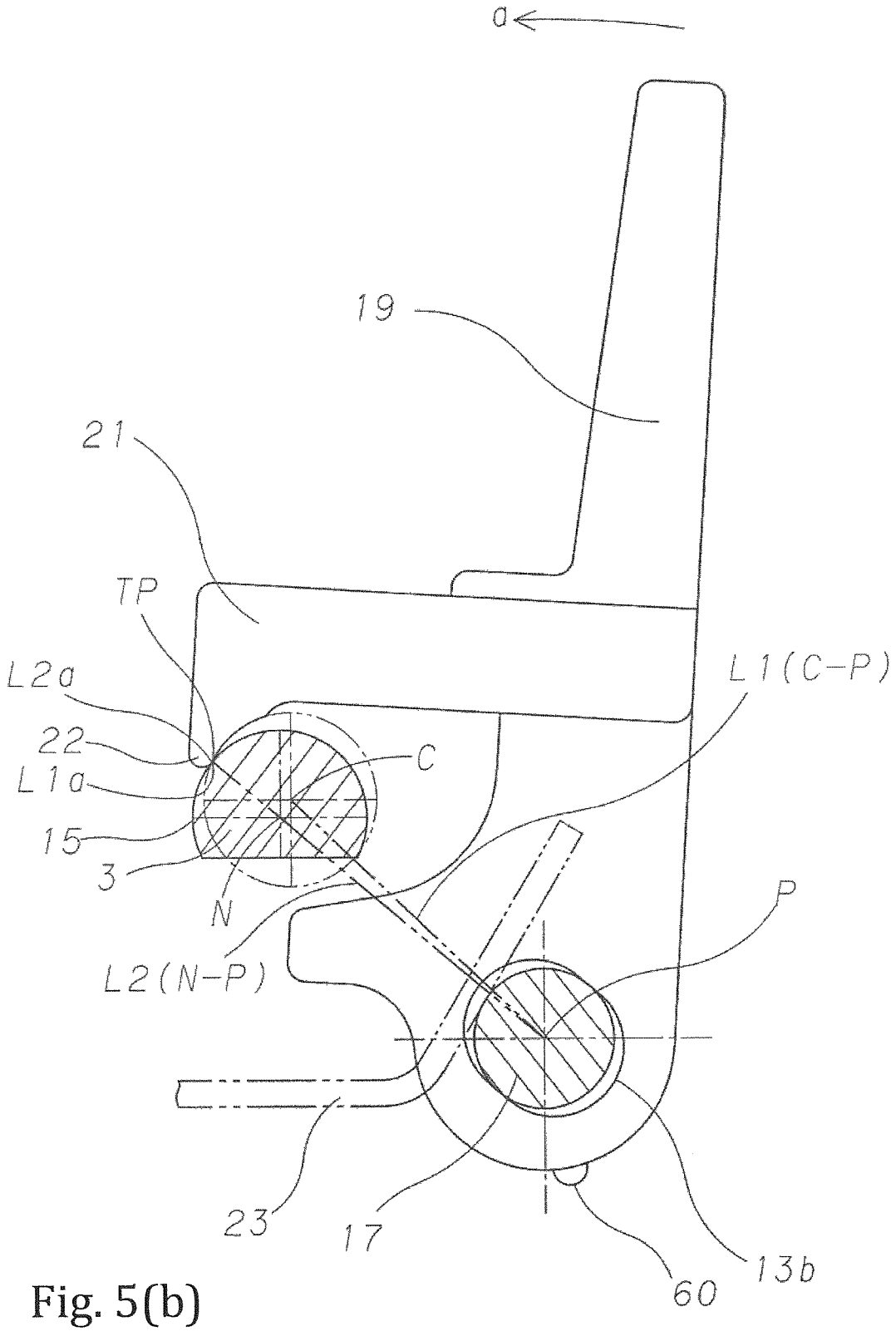
Figure 5C:
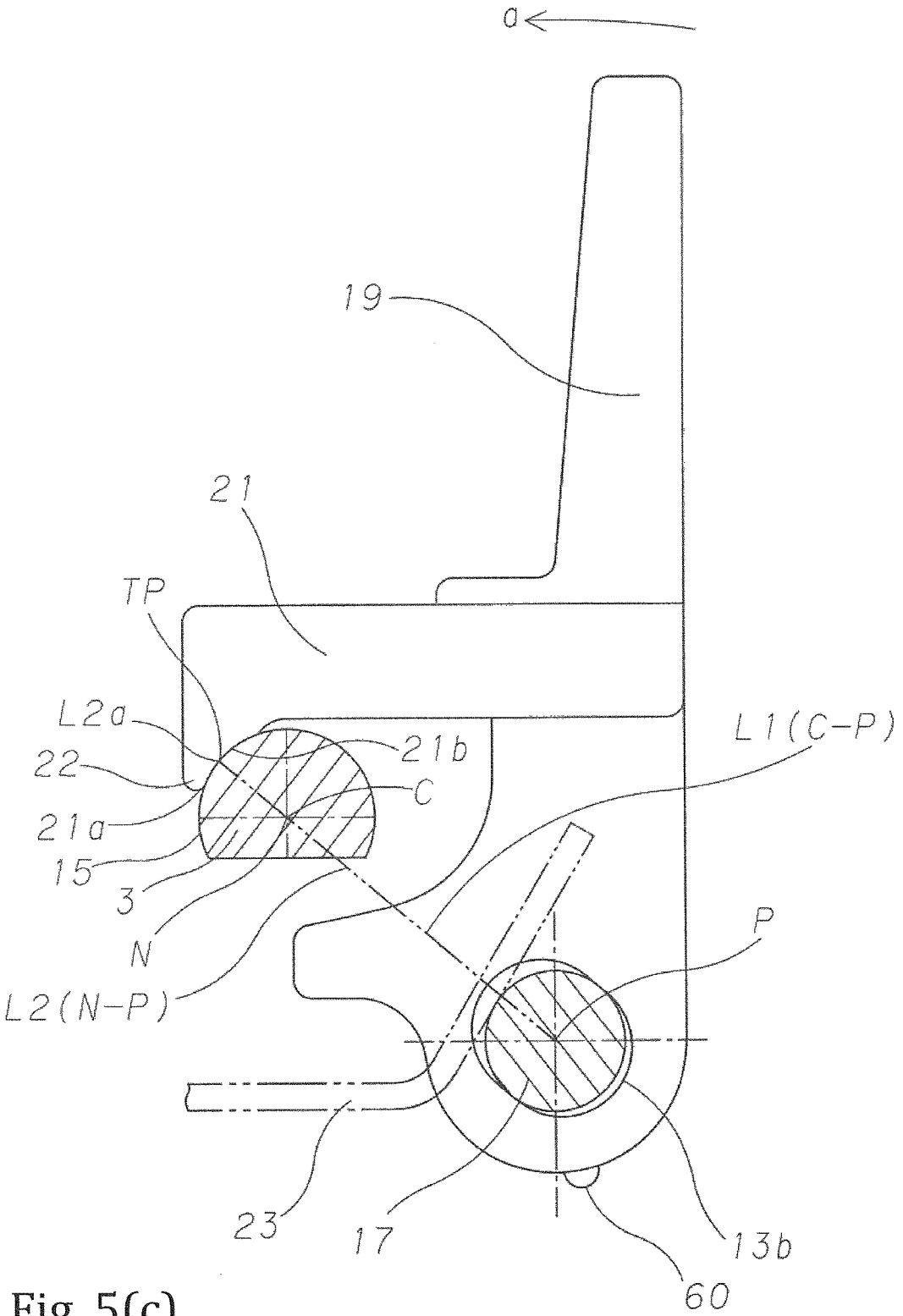

In the sewing machine needle clamping device 1, the clamp arm 21 has a force acting locking part 22, which slides on the needle shank 15 of the sewing machine needle 3 against the elasticity of the needle fixing spring 23 when rocking the clamp lever 19 to a clamping direction "a" (FIG. 4 (*b*)-FIG. 4 (*d*), FIG. 5 (*a*)-FIG. 5 (*c*)) in the state that the needle shank 15 of the sewing machine needle 3 is engaged to the accommodating recessed part 7 and butted in the attaching position 7*b* (FIG. 2 (*a*)) of the vertical direction, and which passes a branch point position tp (FIG. 5 (*b*)-FIG. 5 (*c*)) that the elasticity of the needle fixing spring 23 of the straight line L2 which links the central point N of the needle shank 15 of the sewing machine needle 3 and the central point P of the clamp lever shaft 17 becomes maximum, and which holds a stable clamping state by the elasticity of the needle fixing spring 23.

According to the sewing machine needle clamping device 1 of the present invention which is composed in this way, in the state before clamping the sewing machine needle 3 to the needle clamp 5, the needle shank 15 of the sewing machine needle 3, the clamp lever shaft 17 of the needle clamp 5 and the clamp arm 21 of the clamp lever 19 are positional relations shown in FIG. 4 (*a*).

According to the sewing machine needle clamping device 1 of the present invention, for example, the end face of the shank of the needle shank 15 is butted to different attaching position of vertical direction in the inside of the needle clamp 5 and the attaching flat surface 15*a* which is provided at the peripheral surface of the needle shank 15 of the sewing machine needle 3 is abutted to the attaching flat surface 7*a* of the accommodating recessed part 7 in the inside of the needle clamp 5 by left hand, and in the state immediately after clamping the clamp lever 19 to the clamping direction "a" by right hand, the clamp lever shaft 17 is repelled elastically and pressed to a hole surface of outside direction of the elongate hole 13*b* in the direction of the straight line which links the central point N of the needle shank 15 of the sewing machine needle 3 and the central point P of the clamp lever shaft 17 by the needle fixing spring 23 (FIG. 5 (*a*)). At this point, the force acting locking part 22 of the clamp arm 21 of the clamp lever 19 cannot climb over the needle shank 15 of the sewing machine needle 3. As shown in FIG. 4 (*b*), A straight-line distance L1*a* which links a tip 21*a* of the clamp arm 21 and the central point P of the clamp lever shaft 17 and the distance L2*a* that a radius of the needle shank is added in the direction of the straight line which links the central point N of the needle shank 15 of the sewing machine needle 3 and the central point p of the clamp lever shaft 17 are mismatched, that is, it is in the relation of L1*a*<L2*a*. In this state, the straight line L1 which links the central point C of an engagement surface 21*b* of the clamp arm 21 that an outer diameter and a curvature of the needle shank 15 are corresponding and the central point P of the clamp lever shaft 17 is deviated from the straight line L2 which links the central point N of the needle shank of the sewing machine needle and the central point P of the clamp lever shaft greatly in an angle.

According to the sewing machine needle clamping device 1 of the present invention, the end face of the shank of the needle shank 15 of the sewing machine needle 3 is butted to the attaching position of the vertical direction in the inside of the needle clamp 5 and the attaching flat surface 15*a* which is provided at the peripheral surface of the needle shank 15 of the sewing machine needle 3 is abutted to the attaching flat surface 7*a* of the accommodating recessed part 7 in the inside of the needle clamp 5, and in the state after further continuing the clamping operation of the clamp lever 19 to the direction of the arrow "a", the tip 21*a* of the clamp arm 21 of the clamp lever 19, that is the force acting locking part 22 resists elastic repulsion of the needle fixing spring 23 for climbing over the needle shank 15 of the sewing machine needle 3 and moves to the direction of the central point N of the needle shank 15 of the sewing machine needle 3 in the inside of the elongate hole 13*b* (FIG. 5 (*b*)). As shown in FIG. 4 (*c*), in this state, in the sewing machine needle 3, the needle clamp 5 and the clamp lever 19, the straight line L1 which links the central point C of the engagement surface 21*b* of the clamp arm 21 and the central point P of the clamp lever shaft 17 deviates slightly from the straight line L2 which links the central point N of the needle shank 15 of the sewing machine needle 3 and the central point P of the clamp lever shaft 17 in the angle. Besides, in other words, in this state, the straight-line distance L1*a* which links the tip 21*a* of the clamp arm 21 and the central point P of the clamp lever shaft 17 and the distance L2*a* that the radius of the needle shank is added in the direction of the straight line which links the central point N of the needle shank 15 of the sewing machine needle 3 and the central point P of the clamp lever shaft 17 are corresponding, that is, it is L1*a*=L2*a*. However, in the needle shank 15 of the sewing machine needle 3, the clamp lever shaft 17 of the needle clamp 5 and the clamp arm 21 of the clamp lever 19, the distance L1 which links the central point C of the engagement surface 21*b* of the clamp arm 21 and the central point P of the clamp lever shaft 17 and the distance L2 which links the central point N of the needle shank of the sewing machine needle and the central point P of the clamp lever shaft 17 are mismatched, that is, it is L1>L2 (FIG. 5 (*b*)).

Figure 6A:
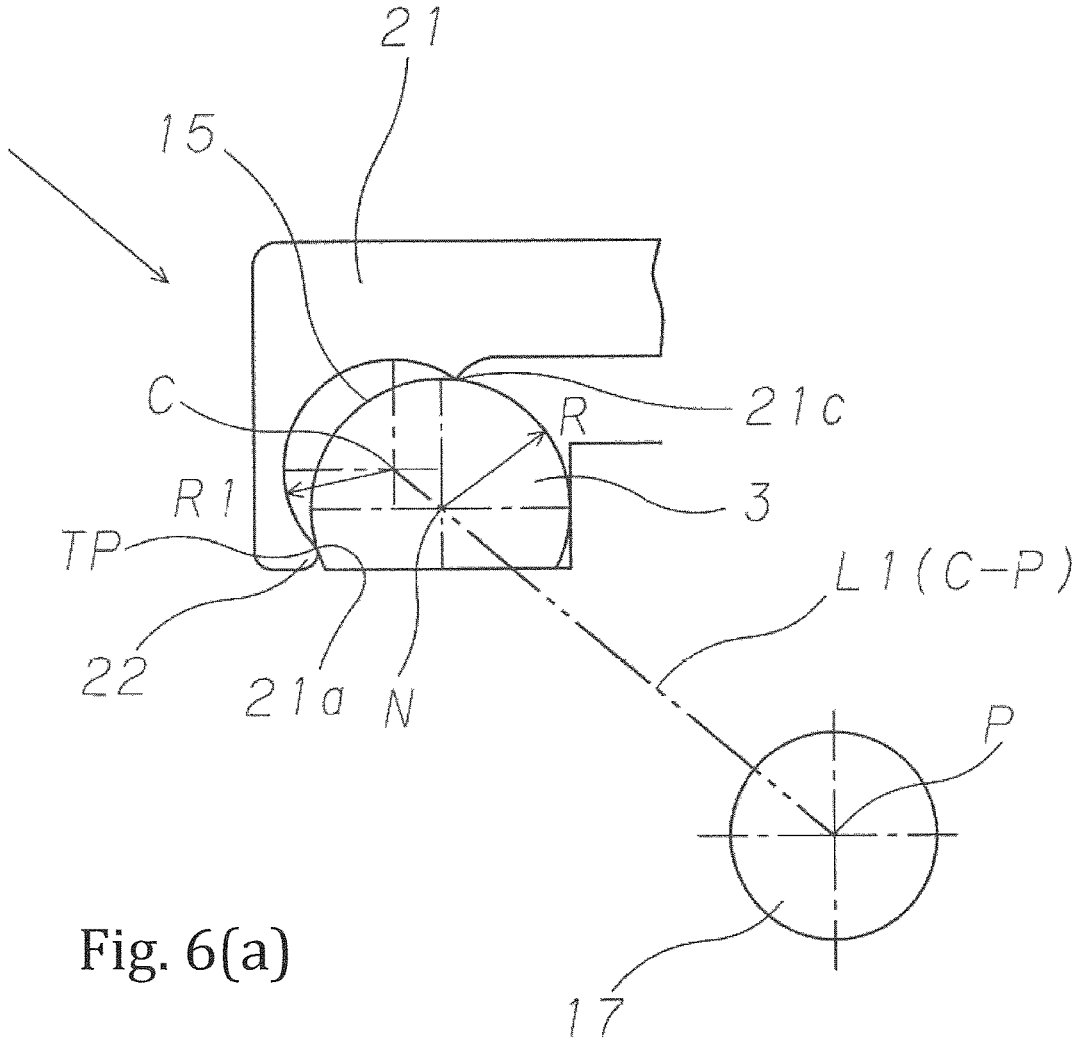
FIG. 6 (*a*) A schematic view of the sewing machine needle clamping device by second embodiment of the present invention.
Figure 6B:
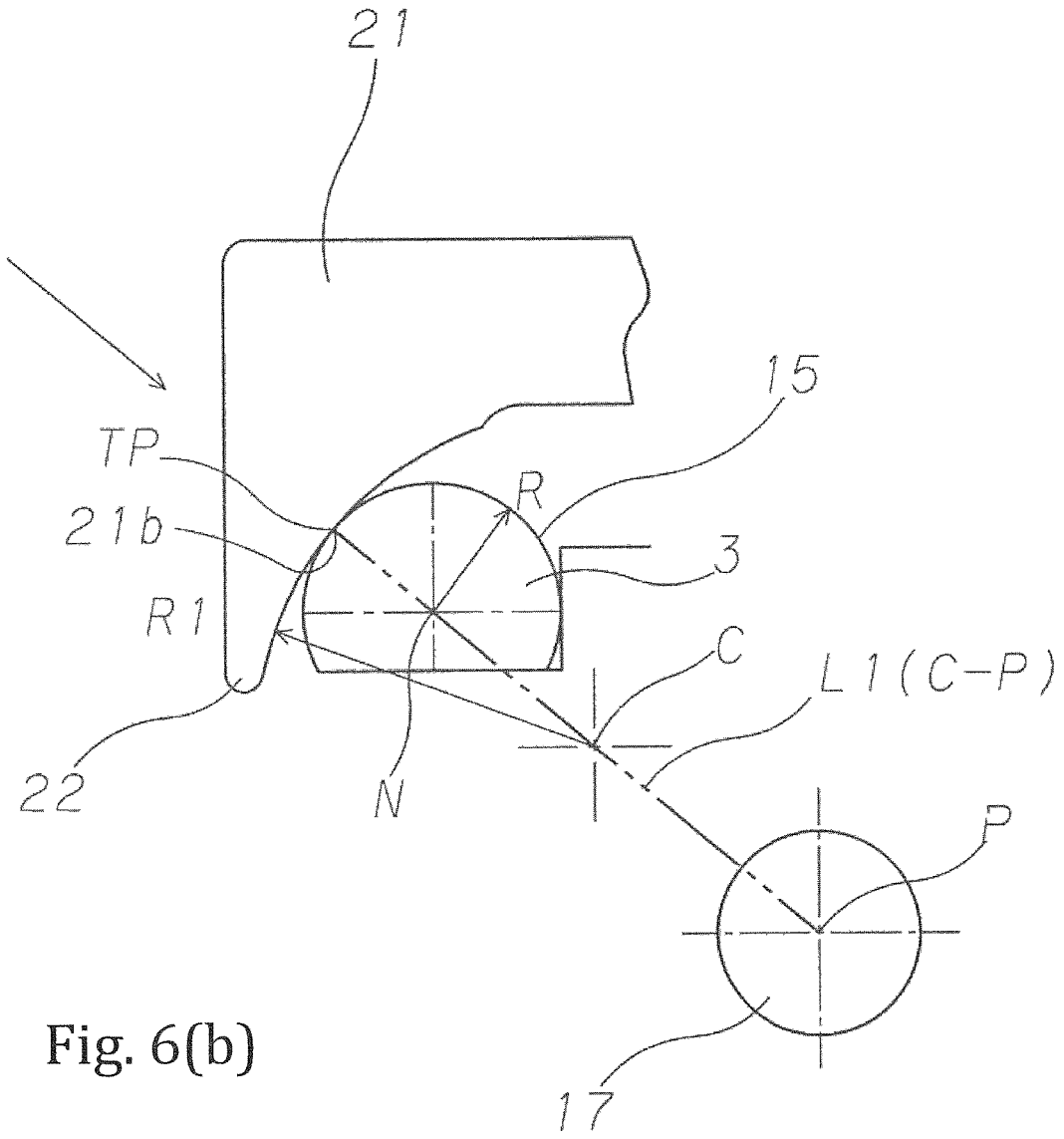

According to the sewing machine needle clamping device 1 of the present invention, the end face of the shank of the needle shank 15 of the sewing machine needle 3 is butted to the attaching position of the vertical direction in the inside of the needle clamp 5 and the attaching flat surface 15*a* which is provided at the peripheral surface of the needle shank 15 of the sewing machine needle 3 is abutted to the attaching flat surface 7*a* of the accommodating recessed part 7 in the inside of the needle clamp 5, and in the state which completed the clamping operation of the clamp lever 19 to the direction of the arrow "a", in other words, in the clamping state, if the tip 21*a* of the clamp arm 21 of the clamp lever 19, that is, if the force acting locking part 22 climbs over the branch point position tp that elastic force of the needle fixing spring 23 on the straight line L2 which links the central point N of the needle shank 15 of the sewing machine needle 3 on the needle shank 15 of the sewing machine needle 3 and the central point P of the clamp lever shaft 17 becomes maximum, the curvature of the needle shank 15 of the sewing machine needle 3 and the curvature of the clamp arm 21 of the clamp lever 19 are corresponding, thereby the clamp lever shaft 17 returns toward the hole surface of outside direction of the elongate hole 13*b* in the direction of the straight line which links the central point N of the needle shank 15 of the sewing machine needle 3 and the central point P of the clamp lever shaft 17, and the central point C of the engagement surface 21*b* of the clamp arm 21 and the central point N of the needle shank 15 of the sewing machine needle 3 are corresponding (FIG. 5 (*c*)). As a result, the force F which repels elastically and presses the clamp lever shaft 17 to the direction of the central point N of the needle shank 15—the central point P of the clamp lever shaft 17 operates and the sewing machine needle 3 is fixed stably by the needle fixing spring 23. The stable clamping state is held in this positional relation. As shown in FIG. 4 (*d*), in this state, the sewing machine needle 3, the needle clamp 5 and the clamp lever 19 are composed as sizes that the straight line L1 which links the central point C of the engagement surface 21*b* of the clamp arm 21 and the central point P of the clamp lever shaft 17 is corresponding to the straight line L2 which links the central point N of the needle shank 15 of the sewing machine needle 3 and the central point P of the clamp lever shaft 17. In addition, in other words, in this state, in the needle shank 15 of the sewing machine needle 3, the clamp lever shaft 17 of the needle clamp 5 and the clamp arm 21 of the clamp lever 19, the distance L1 which links the central point C of the engagement surface 21*b* of the clamp arm 21 and the central point P of the clamp lever shaft 17 is corresponding to the distance L2 which links the central point N of the needle shank of the sewing machine needle and the central point P of the clamp lever shaft. That is, it becomes L1=L2 (FIG. 5 (*c*)).

in the sewing machine needle clamping device of the abovementioned first embodiment, although a circumferential surface of the needle shank 15 of the sewing machine needle 3 and a curved surface of the clamp arm 21 of the clamp lever 19 are corresponding, in the second embodiment shown in FIG. 6 (*a*), a curvature radius of the circumferential surface of the needle shank 15 of the sewing machine needle 3 is larger than that of the curved surface of the clamp arm 21 of the clamp lever 19. In this case, in the clamping state, the force acting locking part 22 climbs over the branch point position tp and the stable clamping state is held.

Besides, in the third embodiment shown in FIG. 6 (*b*), the curvature radius of the circumferential surface of the needle shank 15 of the sewing machine needle 3 is smaller than that of the curved surface of the clamp arm 21 of the clamp lever 19. In this case, in the clamping state, the force acting locking part 22 climbs over the branch point position tp and the stable clamping state is held.

Figure 7:
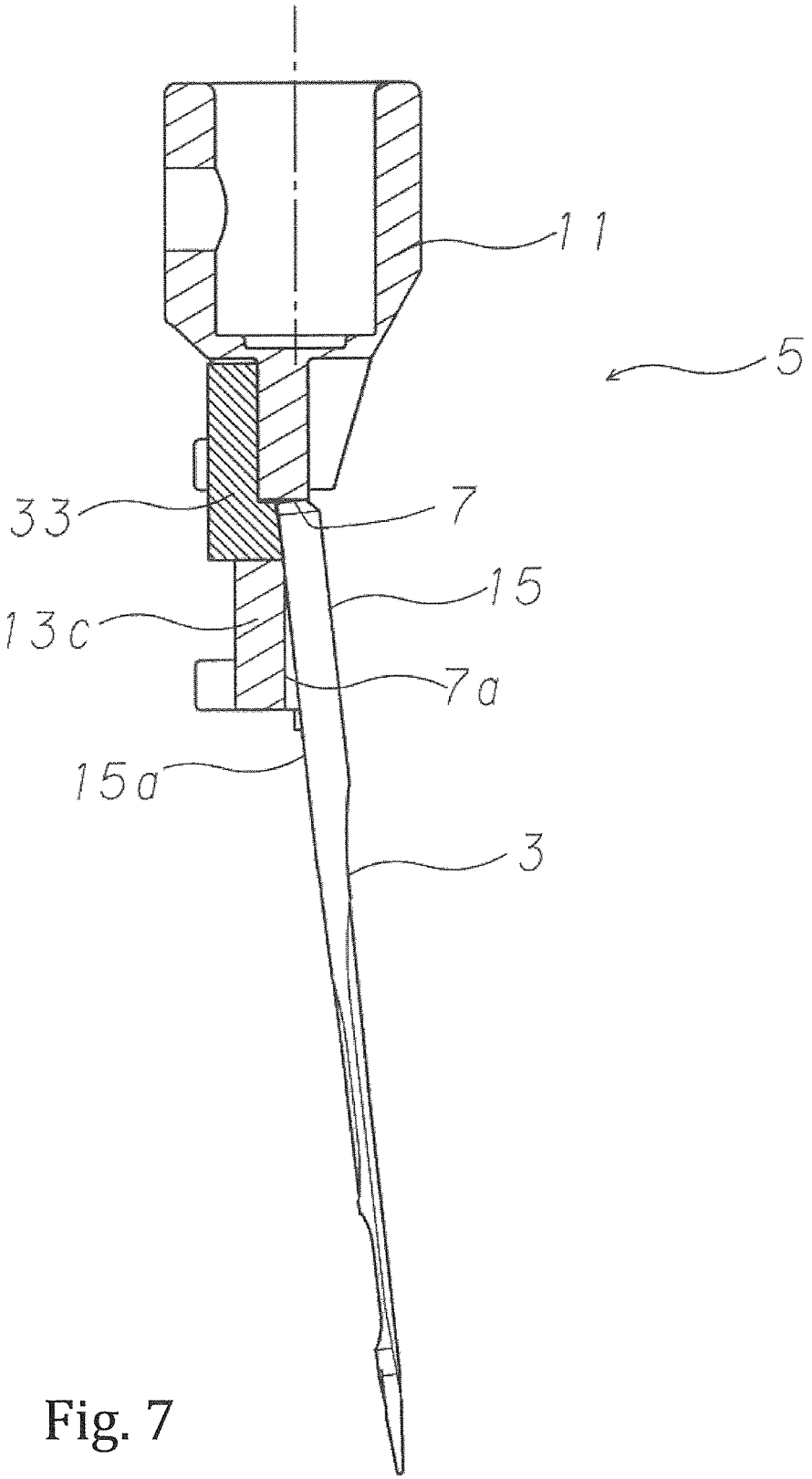
FIG. 7 A schematic view for holding a position of these states temporarily in an inside of an accommodating recessed part before clamping the sewing machine needle to the needle clamp when using the sewing machine needle clamping device by the present invention.

In addition, as shown in FIG. 7, in the sewing machine needle clamping device of the present invention, a magnetic body 33 which attracts magnetically the needle shank 15 of the sewing machine needle 3 which is formed by magnetic material is incorporated in the accommodating recessed part 7 which accommodates the needle shank 15 of the sewing machine needle 3. According to this structure, when the end face of the shank of the needle shank 15 of the sewing machine needle 3 is butted to the attaching position of the vertical direction in the inside of the needle clamp 5, the attaching flat surface 15*a* which is provided at the peripheral surface of the needle shank 15 of the sewing machine needle 3 is abutted to the attaching flat surface 7*a* of the accommodating recessed part 7 in the inside of the needle clamp 5 and the sewing machine needle 3 is attached to the needle shank 15, before clamping, because these state positions can be held temporarily in the inside of the accommodating recessed part 7 by one-touch operation, attaching work is easy.

As it is clear from the above explanation, according to the sewing machine needle clamping device of the present invention, the operation which has to screw the thin sewing machine needle by the screw to the needle clamp of small space firmly by the screwdriver is unnecessary and the mechanism is simplified and the operation is performed by one-touch operation of small number of times, and the sewing machine needle such as the lock stitch sewing machine, the serger, the double chain stitch sewing machine, or the cover stitch sewing machine can be attached, fixed or exchanged to the needle clamp firmly and easily.

INDUSTRIAL APPLICABILITY

Because the sewing machine needle is attached and fixed to the needle clamp firmly and easily, the sewing machine needle clamping device in the present invention can be applied suitably to various types of the sewing machine such as the lock stitch sewing machine, the serger, the double chain stitch sewing machine, or the cover stitch sewing machine.

EXPLANATION OF THE NUMERALS

1 sewing machine needle clamping device
3 sewing machine needle
5 needle clamp
7 accommodating recessed part
7*a* attaching flat surface
9 screw
11 fixing cylindrical portion
13 attaching base
13*a* attaching part
13*b* elongate hole
13*c* attaching part of vertical direction
15 needle shank
15*a* attaching flat surface
17 clamp lever shaft

19 clamp lever
21 clamp arm
21*a* tip of clamp arm
21*b* engagement surface
22 force acting locking part
23 needle fixing spring
25 spring
27 screw
29 thread guide
31 screw
33 magnetic body
40 hemstitch sewing machine (serger)
42 throat plate
44 looper as loop capturing device
46 lower shaft
48 lower shaft pulley
50 timing belt
52 upper shaft pulley
54 upper shaft
56 needle bar drive mechanism
58 needle bar
a clamping direction
L1 straight-line distance which links central point of engagement surface of clamp arm and central point of clamp lever shaft
L1*a* straight-line distance which links tip of clamp arm and central point of clamp lever shaft
L2 straight-line distance which links central point of needle shank and central point of clamp lever shaft
L2*a* distance that radius of needle shank is added in direction of straight line which links central point of needle shank of needle and central point of clamp lever shaft
C central point of engagement surface of clamp arm
N central point of needle shank
P central point of clamp lever shaft
tp branch point position

The invention claimed is:

1. A sewing machine needle clamping device for attaching a sewing machine needle to an accommodating recessed part of a needle clamp with the needle clamp comprising the accommodating recessed part accommodating a needle shank of the sewing machine needle, comprising:

a clamp lever which can rock freely and has a clamp arm which engages to the needle shank of said sewing machine needle, is freely opened and closed for said accommodating recessed part and is fixed to a clamp lever shaft which is fitted loosely to an elongate hole which is bored at said needle clamp, and a needle fixing spring which repels elastically said clamp lever to an outer direction of a straight line which links a central point of the needle shank of said sewing machine needle and a central point of said clamp lever shaft, wherein the clamp arm has a force acting locking part, sliding on the needle shank of said sewing machine needle against elasticity of said needle fixing spring when rocking said clamp lever to a clamping direction in a state that the needle shank of said sewing machine needle is engaged to said accommodating recessed part and butted in the attaching position of a vertical direction, and passing a branch point position that the elasticity of said needle fixing spring of the straight line which links the central point of the needle shank of said sewing machine needle and the central point of said clamp lever shaft becomes maximum, and holding a stable clamping state by the elasticity of said needle fixing spring.

2. A sewing machine needle clamping device according to claim 1, wherein:

the needle shank of said sewing machine needle, the clamp lever shaft of said needle clamp and the clamp arm of said clamp lever are composed as sizes that a straight line and a distance which link the central point of an engagement surface of said clamp arm and the central point of said clamp lever shaft are corresponding to a straight line and a distance which link the central point of the needle shank of said sewing machine needle and the central point of said clamp lever shaft in a clamping state.

3. A sewing machine needle clamping device according to claim 1 or claim 2, wherein:

said clamp lever of said needle clamp is freely opened and closed for said accommodating recessed part and is fixed to said clamp lever shaft which is pivotally attached to said elongate hole which is bored at an attaching part which is provided up and down in an attaching base of said needle clamp, and when said clamp lever shaft is pivotally attached in said elongate hole, it can pivotally move, and is stopped so that it cannot move in a vertical direction, and an elongate direction of said elongate hole is same direction as a straight line which links the central point of the needle shank of said sewing machine needle which is accommodated in said accommodating recessed part of said needle clamp and the central point of said clamp lever shaft.

4. A sewing machine needle clamping device according to any one of claim 1 to claim 2, wherein:

a magnetic body which attracts magnetically the needle shank of said sewing machine needle is incorporated in said accommodating recessed part which accommodates the needle shank of said sewing machine needle.

* * * * *